US009581000B2

(12) United States Patent
Morrow

(10) Patent No.: US 9,581,000 B2
(45) Date of Patent: Feb. 28, 2017

(54) SHAFT SEAL PRESSURE COMPENSATION APPARATUS

(71) Applicant: HARRIER TECHNOLOGIES, INC., Greenwich, CT (US)

(72) Inventor: William Bruce Morrow, Santa Barbara, CA (US)

(73) Assignee: HARRIER TECHNOLOGIES, INC., Greenwich, CT (US)

( * ) Notice: Subject to any disclaimer, the term of this patent is extended or adjusted under 35 U.S.C. 154(b) by 244 days.

(21) Appl. No.: 14/506,764

(22) Filed: Oct. 6, 2014

(65) Prior Publication Data

US 2015/0096737 A1 Apr. 9, 2015

Related U.S. Application Data

(60) Provisional application No. 61/888,131, filed on Oct. 8, 2013.

(51) Int. Cl.

| | |
|---|---|
| ***E21B 43/11*** | (2006.01) |
| ***E21B 43/12*** | (2006.01) |
| ***E21B 4/00*** | (2006.01) |

(52) U.S. Cl.

CPC ..... *E21B 43/128* (2013.01); *E21B 4/003* (2013.01)

(58) Field of Classification Search

CPC .... E21B 43/128; E21B 43/129; F04D 13/062; F04D 13/10; F04B 47/06

See application file for complete search history.

(56) References Cited

U.S. PATENT DOCUMENTS

| | | | | |
|---|---|---|---|---|
| 6,305,402 | B2 * | 10/2001 | Pringle | 137/155 |
| 6,666,664 | B2 * | 12/2003 | Gross | E21B 43/128 166/105 |
| 7,278,489 | B2 * | 10/2007 | Matic | E21B 43/129 137/155 |
| 7,530,391 | B2 * | 5/2009 | Hall | E21B 43/128 166/105 |
| 7,708,534 | B2 * | 5/2010 | Parmeter | F04D 29/051 166/105 |
| 8,534,361 | B2 * | 9/2013 | Plunkett | E21B 34/101 137/462 |
| 8,641,389 | B2 * | 2/2014 | McKinney | E21B 43/128 417/414 |
| 8,932,034 | B2 * | 1/2015 | McKinney | E21B 43/128 166/105 |
| 2011/0236233 | A1 * | 9/2011 | Merill | F04B 17/03 417/410.1 |
| 2015/0114662 | A1 * | 4/2015 | Hendryx | E21B 43/128 166/369 |

(Continued)

*Primary Examiner* — Joshua Kennedy
(74) *Attorney, Agent, or Firm* — Ladas & Parry LLP

(57) ABSTRACT

A pressure compensating system that minimizes the pressure differences across multiple shaft seals in a rod driven downhole pumping apparatus. The system balances the pressures across the seals by forcing the external pressure of all seals and compensators to be equal to the highest external pressure in the apparatus, made possible by the appropriate use of labyrinth-type seals. A bleed valve assembly which allows free flow of fluid into the pressure compensating system, but restricts the rate of fluid outflow from the system in case of shut-in of the pump, to limit the potential of rapid opening and closing of the mechanical shaft seals.

3 Claims, 5 Drawing Sheets

(56) References Cited

U.S. PATENT DOCUMENTS

2015/0325997 A1* 11/2015 Burrow ..... H01R 13/523
174/19
2015/0361744 A1* 12/2015 Xu ..... E21B 47/011
166/243

* cited by examiner

SHAFT SEAL PRESSURE COMPENSATION APPARATUS

Applicant claims the benefits of provisional application Ser. No. 61/888,131, filed Oct. 9, 2013. The present invention relates, in a general sense, to pressure compensation apparatus, with particular emphasis on minimization of pressure differentials across shaft seals in downhole elements.

BACKGROUND OF THE INVENTION

Many mechanical devices which utilize a lubricated rotating shaft as a component require seals on those shafts to either contain a pressurized fluid, e.g., for a shaft driving a pump, or to isolate one component from contamination, or both.

In the case of downhole rotating equipment, such as an electrical submersible pump (ESP), or a geared centrifugal pump (GCP), the rotating shafts require seals, principally to protect the fluids inside sensitive components, such as the electric motor (ESP) or the transmission (GCP), from contamination such as from production fluids.

The seals in these two applications are not called upon to withstand significant a pressure differential, as they are typically equipped with pressure compensators that keep both sides of the seal at near equal pressures. This is important in downhole equipment applications, as the devices are designed to operate essentially maintenance and service free, while at full power, and for years, so leakage across the seals must be kept to a minimum. If, as and when maintenance or repair is called for, the entire string must be pulled adding an inordinate loss of time and consequent expense.

OVERVIEW OF THE PRIOR ART

The shaft seal types used most commonly in these downhole applications are end face mechanical seals such as that shown in FIG. 1. These seals consist of two ring-shaped sealing elements with very flat surfaces that bear on one another, one such surface 10 being fixed, and the other, 12, attached to the rotating shaft 13. The sealing elements are kept in contact via a spring 14, or bellows. These elements require a thin layer of fluid between them to lubricate the surfaces, or rapid erosion of one or both elements would occur. Because of this, this type of seal leaks, the rate of leakage depending principally upon the pressure differential across the seals.

In electric submersible pump applications, only one set of seals is required to protect the electric motor. Such an arrangement is illustrated in FIG. 2. This configuration allows for effective pressure balance between the electric motor and the seals 16, with nearly nil differential pressure.

In the geared centrifugal pump application, there is a set of seals above and below the transmission (FIG. 3*a*), and a pressure difference between them is due to the pressure drop from flow within the assembly (FIG. 3*b*). The existing system uses a main transmission pressure compensator 18, in the upper seal section 20, so there is little pressure differential between the ambient pressure, e.g., the pressure in the vicinity of the seal $P_{US}$, and the transmission T. Hence, there is little pressure differential across these upper seals 21. The seals 23 in the lower seal section 25, however, are exposed to an ambient pressure, $P_{LS}$, that in some instances can be several psi greater than that in the upper seal section (FIG. 3*b*), and, hence, the lower seals can see pressure differentials of several psi between their ambient pressure and the pressure inside the transmission. This significant pressure differential can result in excessive seal leakage, and premature contamination of the transmission lubricant and subsequent transmission failure.

SUMMARY OF THE INVENTION

The present invention addresses the excessive differential pressure in one set of seals, having as its objective, the balancing of fluid pressures, including ambient pressure, for all seals, both upper and lower, thereby minimizing the differential pressure between all seals and transmission they protect. An objective related to the foregoing is the extension of times related to maintenance and repair of existing components which might otherwise occur due to contamination and leakage of fugitive fluids.

Those skilled in the art will, upon reading of the forthcoming Detailed Description of a Preferred Embodiment, see additional objectives to be accomplished by the present invention, when read in concert with the drawings, wherein:

DETAILED DESCRIPTION A PREFERRED EMBODIMENT

Figure 1:
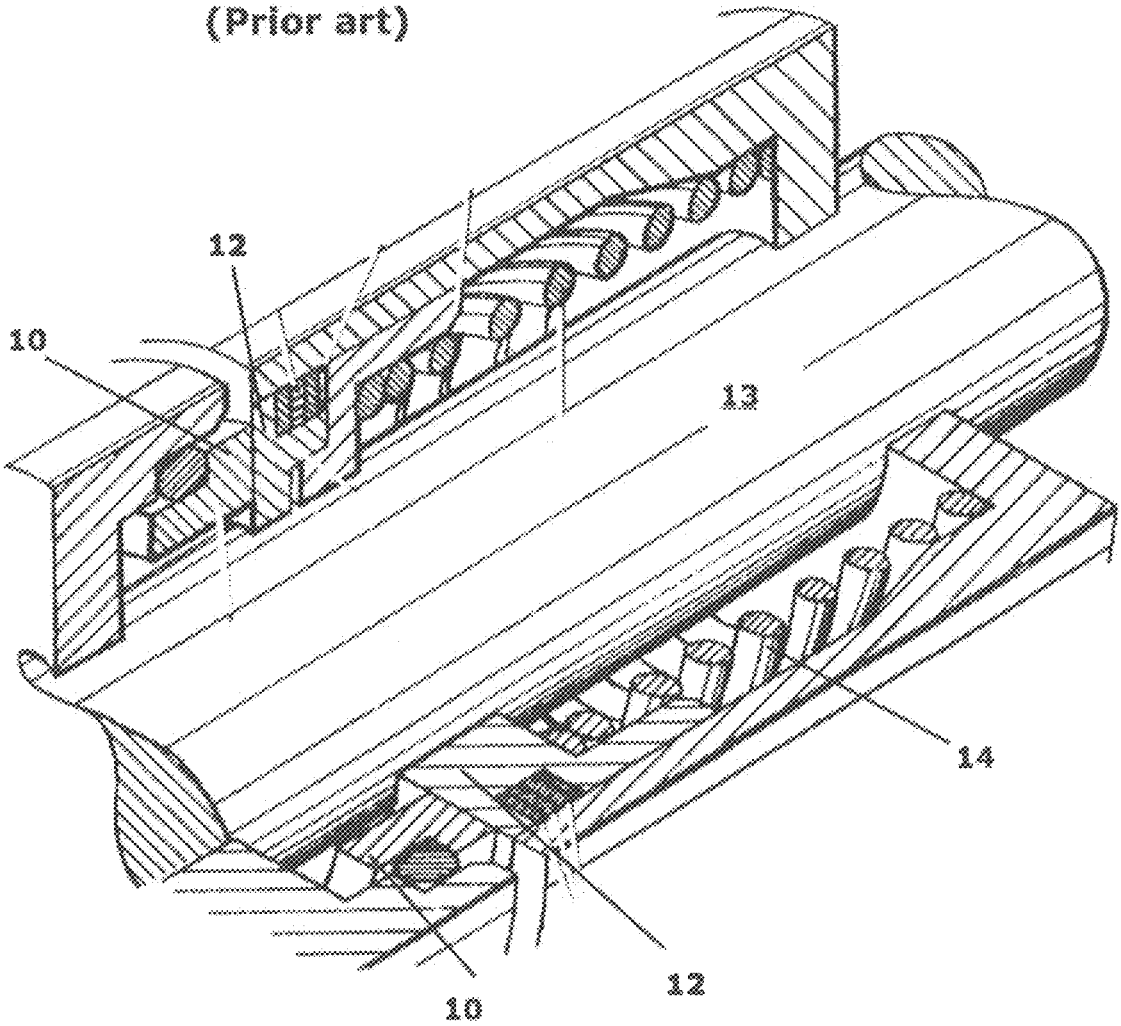
FIG. 1 (Prior art)
FIG. 1 is a partial cut away depiction of a typical prior art end face mechanical seal, as previously described.
Figure 2:
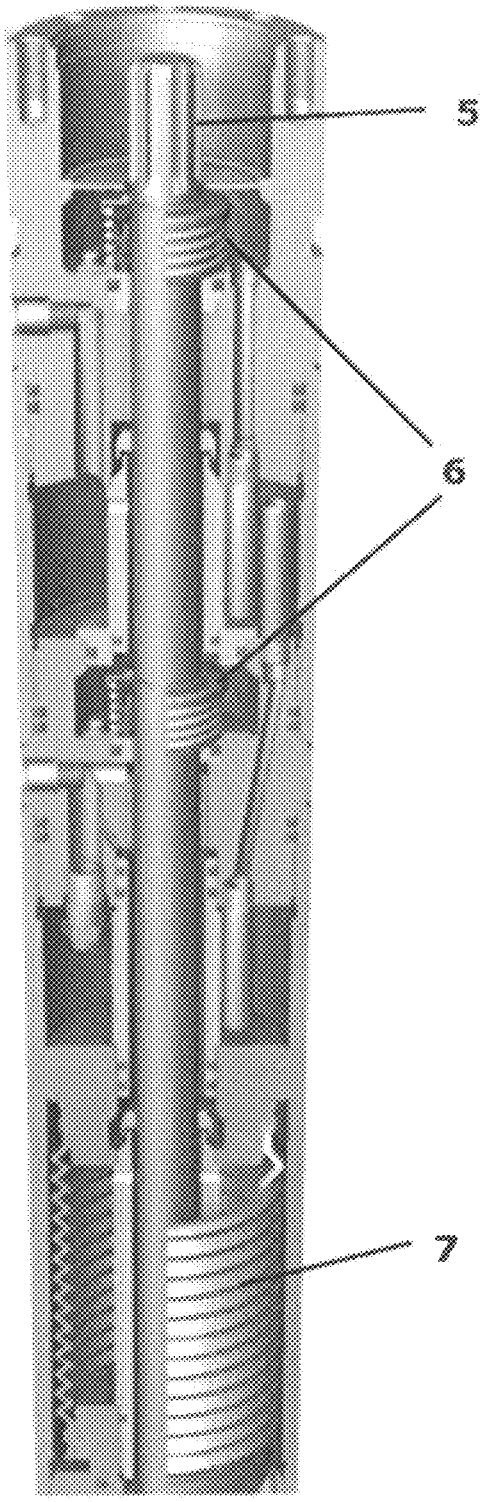
FIG. 2 (Prior art)
FIG. 2 is a partial cut away drawing of a prior art seal assembly for an electrical submersible pump system.
Figure 3A:
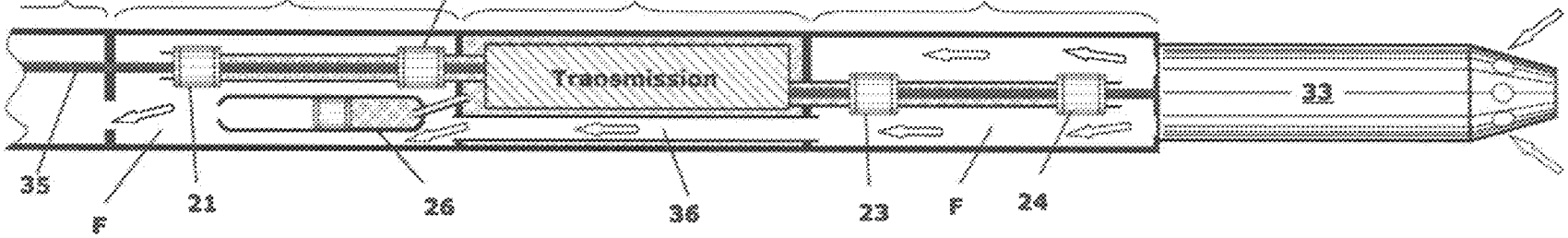
FIG. 3a (Prior art)
FIG. 3*a* is a cross-section of a geared centrifugal pump downhole assembly, illustrating, inter alia, the flow path for produced fluids from the pump past the individual components of the assembly.

Referring now to the drawings, and initially to FIG. 3*a*, the current layout of a GCP, with the current configuration of the upper and lower seal sections, 20 and 25, respectively, is shown. The multi-stage centrifugal pump 33 is driven via a rotating drive rod string 35, and a step up, or speed-increasing transmission T. The high pressure production fluid F discharged from the pump flows through the lower seal section 25 and into the D-tube flow channels 36, through the transmission section T, into and through the upper seal section 20, into the receiver 39 and then into the tubing (not shown) on its way to the surface, as indicated by the arrows.

The flow of production fluid along this path between the pump 33 and the receiver 39 results in a frictional pressure drop that can exceed 5 psi for large flow rates (~5000 bfpd). This pressure drop is shown graphically on FIG. 3*b*. The pressure drop through the transmission section D-tubes 36 is the steepest due to the restricted cross-sectional area of the D-tubes, compared to the flow area available in the upper and lower seal sections 20, 25.

Since the transmission pressure compensator 26 is located in the upper seal section 20, the pressure inside the transmission section is maintained at the same level as the average pressure in the upper seal section, $P_{US}$. The upper seal section shaft seals 21 and 22 are exposed to the ambient pressure, $P_{US}$, and seal against a transmission pressure that is essentially the same, due to the pressure compensation, hence, having essentially nil differential pressure across them.

Figure 3B:
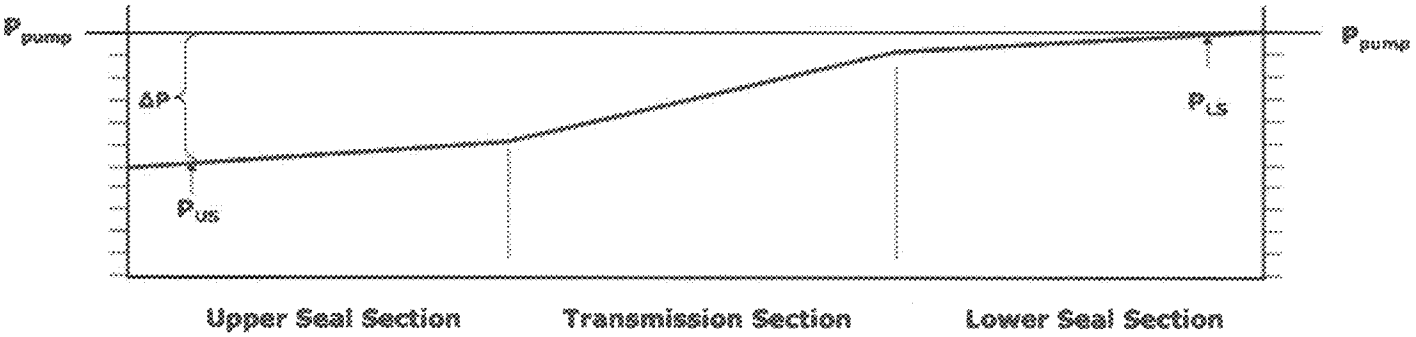
FIG. 3b (Prior art)
FIG. 3*b* is a graph showing the variation of pressures within the components of the downhole assembly during high rate production.

The shaft seals 23 and 24, in the lower seal section 25, on the other hand, are exposed to an ambient pressure equal to $P_{LS}$ (lower section), which can be several psi greater than $P_{US}$ (upper section), e.g., $\Delta P$ as shown in FIG. 3*b*. Since the pressure in the transmission section is maintained at $P_{US}$, the lower seals 23 and 24 operate with a pressure differential of $\Delta P$. This can be expected to result in excessive seal leakage and an unacceptable invasion of the transmission lubricant by production fluids, which often includes corrosives such as salt water, which will inevitably result in transmission failure.

Figure 4A:
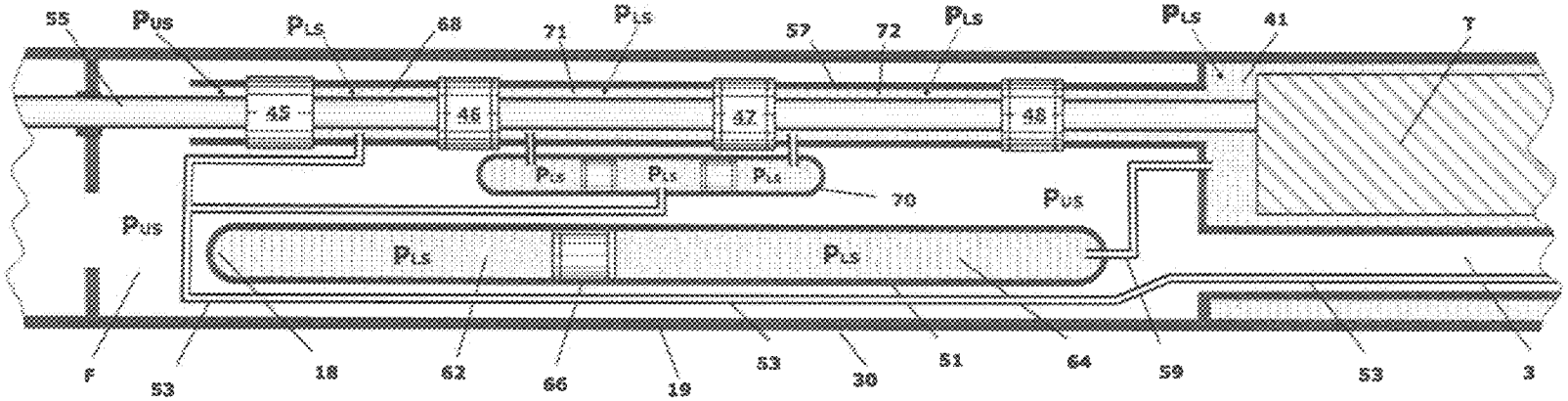
FIG. 4*a* is a longitudinal cross-section of the upper seal section and parts of the transmission section and receiver sections of the geared centrifugal pump downhole assembly in the proposed configuration, for the present invention.
Figure 4B:
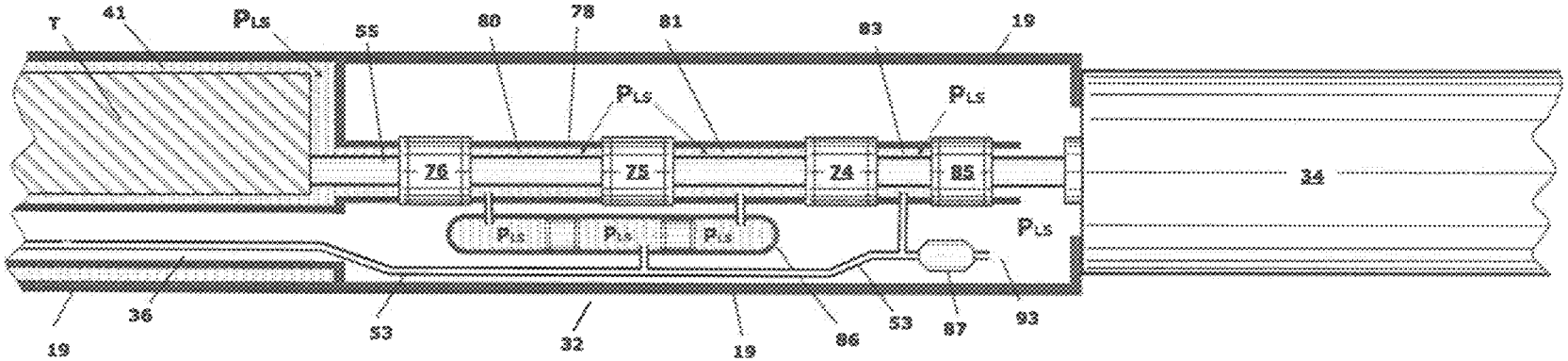
FIG. 4*b* is a longitudinal cross-section of the lower seal section and parts of the transmission section and centrifugal pump of the geared centrifugal pump downhole assembly constructed in the inventive configuration.

The present invention, the objectives of which include remedying the problem of excessive pressure differential across the lower seals, is shown in FIGS. 4*a* and 4*b*. The principal difference between the configuration shown in FIG. 4*a* and that in FIG. 3*a* is the source of external pressure for the upper seal section shaft seal 21 and main transmission pressure compensator 18. In the FIG. 3*a* configuration, upper seal section shaft seal 21 and the transmission compensator 26 are vented to the interior flow area of the upper seal section 20, which has a pressure $P_{US}$. This results in the transmission internal pressure to also be $P_{US}$.

In keeping with the objectives of the invention, a somewhat modified structure is detailed in FIG. 4*a*, where there is diagramed an upper seal section 30, which protects the transmission section from production fluid contamination. This objective is accomplished by means of a series of shaft seals 45, 46, 47 and 48, operating in concert with a main transmission pressure compensator 51.

In order to achieve the pressure balance required to avoid damage to the seals and maintain optimum performance for extended periods while the system is down hole, the upper seal section 30 communicates with the various elements in the section by means of a pressure compensation line or tube 53. The tube 53 extends from the lower seal section 32 (FIG. 4*b*) to the input drive shaft housing 57, with parallel connections to the external chamber 62 of the main pressure compensator 51, and to the upper seal pressure compensator 70. In addition, tube 59 connects the internal chamber 64 of main pressure compensator 51 to the internal portion of the transmission section 41. Upper seal pressure compensator 70 communicates with the inter-seal chambers 71 and 72 to maintain the pressure on each side of the seals 46, 47 and 48 equal to $P_{LS}$.

In the FIG. 4*a* configuration, the inlet 18 at the top 50 of the compensator 51 is not open to the produced fluid flow path of the upper seal section as in FIG. 3*a*, but, instead, is connected to the lower seal section 32 via a tubular flow path fashioned by tube 53. Tube 53 passes through the D-tube 36, (or through the interior of the transmission section) and into the lower seal section 32 to a point adjacent to the lowest shaft seal 85 in the lower seal section (FIG. 4*b*). This now forces the external side 62 of the main compensator 51 to operate at $P_{LS}$ instead of $P_{US}$. The internal side 64 of the compensator 51 will also be at $P_{LS}$ by virtue of the free movement of the piston 66, which isolates the produced fluid in 62 from the transmission lubricant in 64, while providing pressure equilibrium between them. This pressure equilibration also results in the transmission side pressures of the upper seals, 46, 47, and 48, being held at $P_{LS}$.

Line 53 is also connected to inter-seal pressure compensator 70, which maintains the pressure in inter-seal chambers 71 and 72 at $P_{LS}$. Line 53 also connects to a chamber 68, between the first and second shaft seals 45 and 46, respectively, and maintains a pressure in chamber 68 equal to $P_{LS}$. Seal 46 is open only to chamber 68 at its upper end, and to the transmission fluid in the chamber between seals 46 and 47 below, which is kept at $P_{LS}$ by inter-seal pressure compensator 70 so both sides of the seal 46 "see" $P_{LS}$, hence there is nil pressure differential across the seal. The pressures on both sides of shaft seals 47 and 48 are also equal to $P_{LS}$ due to the inter-seal pressure compensator 70 and the main transmission pressure compensator 51 pressure. The inter-seal pressure compensator 70 is also required to provide pressure relief for chambers 71 and 73 in the event of sudden pump stoppage due to power interruption or shut-in. This compensator also provides enough additional communicating volume to compensate for thermal expansion or contraction of the liquid in chambers 47 and 48 due to changes in operating temperature. Only seal 45 experiences a differential pressure equal to $\Delta P$. Since the pressure in chamber 68 is greater than the upper seal section produced fluid flow path (external) pressure $P_{US}$, the leakage through seal 45 is into the upper flow path, and this leakage is made up by flow from the lower seal section via tube 53. Seal 45 would be designed for longevity, not sealing ability, such as a labyrinth seal, as all it must do is allow the chamber to remain at $P_{LS}$ so that seals 46, 47 and 48 continue to have essentially a nil differential pressure. Even a "loose" seal, like a labyrinth seal, leaks at a very low rate compared to what line 53 can provide for make up, so chamber 68 will be easily maintained at $P_{LS}$.

FIG. 4*b* shows the lower seal section 32, which protects the internal portion of the transmission section 41 from contamination by the produced fluid discharged by the centrifugal pump 34. Principal components of this section are the shaft seals 74, 75, 76 and 78, aligned along the drive shaft housing 78. Output shaft 55 extends from the output of the transmission T through the output shaft housing 78, and to the pump 34, where it drives the impellers of the centrifugal pump (not shown). The pressure compensator equalization line 53 is shown passing through the D-tube flow passage 36. Also shown is the pressure compensator 86 for the inter-seal chambers 80 and 81. The pressures within the various components of the lower seal section are indicated.

In the lower seal section 32, the lowest most shaft seal 85 is a labyrinth seal similar to 45 in the upper seal section. The chamber 83 between seal 85 and the next seal 74 is connected to line 53 and is in flow and pressure communication with the external lower seal section volume and, hence, is maintained at pressure $P_{LS}$. Shaft seal 74, in the series that protects the transmission section, experiences an external pressure equal to $P_{LS}$. In addition, line 53 communicates with the lower seal pressure compensator 86, which, in turn, communicates with the inter-seal chambers 80 and 81, so the pressure on both sides of the seals 74, 75 and 76 are equal to $P_{LS}$. Since the internal pressure in the transmission section is maintained at $P_{LS}$ by the pressure compensator 51, as described above, the shaft seals in the lower seal section experience a nil, or near nil, pressure differential. The inter-seal pressure compensator 86 is required to provide pressure relief for chambers 80 and 81 in the event of sudden pump stoppage due to power interruption or shut down, as well as enough additional communicating volume to compensate for thermal expansion or contraction of the liquid in chambers 49 and 50 due to changes in operating temperature. Note near the intake 93 of line 53 is situated a bleed valve assembly 87. This bleed valve assembly 87 allows the free flow of produced fluid from inside lower seal section 32 to enter line 53, but restricts the rate of outflow of fluid from line 53 in the event of a sudden shutting-in of the system. This prevents the rapid loss of pressure in the external chambers of lower inter-seal pressure compensator 86, as well as main compensator 51 and upper inter-seal pressure compensator 70 when pump 34 suddenly stops, from damaging the aforementioned shaft seals.

Figure 5A:
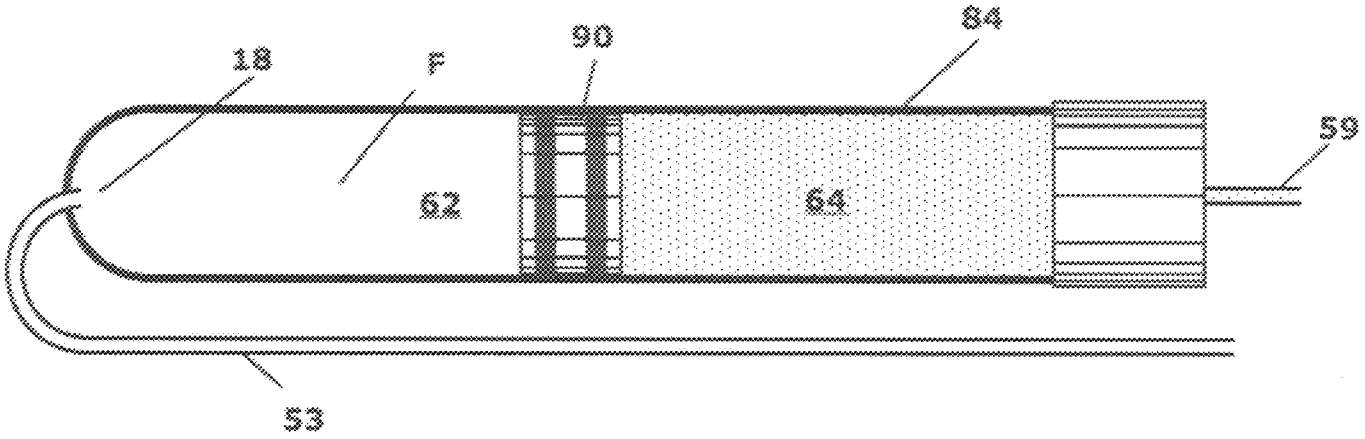
FIG. 5*a* is a cross-section through a pressure compensator using a piston-cylinder system for fluid isolation and pressure equalization; and, FIG. 5*b* is a cross-section through a pressure compensator using an elastomer bladder-type system for fluid isolation and pressure equalization.
Figure 5B:
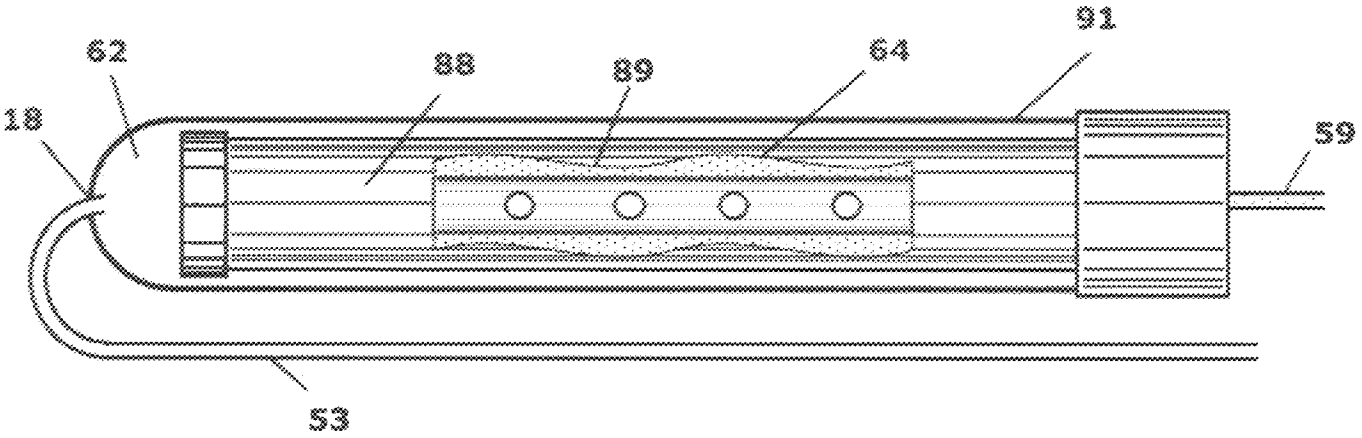

FIGS. 5*a* and 5*b* show alternative designs for the main transmission pressure compensator 51. The FIG. 5*a* configuration consists of a cylinder 84, fitted with a sealing piston 90, that separates the ambient produced fluid F in volume 62, as supplied by line 53, from the transmission lubricating fluid within the transmission side of the compensator 64. Since the sealing piston 90 can move freely within the cylinder, the pressures on each side of the piston are equal. If the pressure in fluid F increases due to flow through line 53, the piston would move to the right, pushing some of transmission lubricating fluid in 64 through line 59 into the transmission, balancing its pressure with the ambient pressure. Likewise, if the pressure in the transmission increased, it would move the piston to the left until the pressures were again balanced.

The FIG. 5*b* configuration uses an elastomer bladder 88 to separate the transmission lubrication fluid from the produced fluid, and, due to the bladder's flexibility, to provide pressure equilibrium. The bladder has a perforated mandrel 89 inside, shown via a cutaway of the bladder material, so that it cannot completely collapse within the housing 91.

While, those skilled in the art may perceive minor variations in specific structures, it will be understood that such minor variations are within the contemplation of the invention as described in the following claims:

The invention claimed is:

1. An improved pressure compensating system for components of a deep well pumping apparatus, comprising:

said pumping apparatus being disposed downhole and connected to the surface by production tubing;

said apparatus being connected to, and rotationally driven by, a drive rod string within said production tubing, said drive rod string connected to, and rotationally driven by a drive head at the surface of the well;

said pumping apparatus consisting of an upper chamber and a lower chamber, a transmission being interposed between the two said chambers, and a pump attached to the lower end of said lower chamber, the upper end of said upper chamber being fixedly attached to and open to flow into the production tubing;

said drive rod string extending through said upper chamber and rotationally connected to said transmission;

a transmission output shaft extending through said lower chamber and rotationally connected to said pump;

wherein pressurized fluid discharged from said pump passes through said lower chamber, through flow channels within the outer housing of said transmission, through the upper chamber and into said production tubing for flow to the surface, said flow channels through said transmission isolate said pressurized fluid discharged from said pump from the internal components of said transmission;

said drive rod string passes through said upper chamber into said transmission and is equipped with at least two drive shaft seals isolating said upper chamber from said transmission;

said output shaft from said transmission passes through said lower chamber, said output shaft being equipped with at least one output shaft seal isolating said transmission from said lower chamber;

an upper chamber pressure compensator within said upper chamber being connected to said transmission;

said upper chamber pressure compensator consists of an external and an internal chamber, the fluid within said external and said internal chambers isolated from one another via a piston, or flexible membrane, said piston or flexible membrane allowing pressure equalization between said chambers;

said external chamber of said upper chamber pressure compensator is connected to said lower chamber via a tubular member, said tubular member allowing pressure and flow communication between said external chamber and said lower chamber;

said tubular member having an inlet end, said inlet end of said tubular member is situated near the lower end of said lower chamber, near the discharge of said pump;

said drive rod string within said upper chamber is enclosed within an upper tubular housing; the upper end of said upper tubular housing in pressure and flow communication with said upper chamber, the lower end of said tubular housing being isolated from said upper chamber;

said at least two drive shaft seals are mounted within said upper tubular housing, said drive shaft seals separated by an inter-seal volume consisting of the annular space between the drive rod string of said upper tubular housing;

said inter-seal volume between said drive shaft seals is connected for pressure communication to said external chamber of said upper chamber pressure compensator;

wherein the lower said drive shaft seal is of a type designed to limit leakage as much as possible, and upper said drive shaft seal is of a type that allows controlled leakage across said seal;

said transmission output shaft within said lower chamber is enclosed within a lower tubular housing, the lower end of said lower tubular housing in pressure and flow communication with said lower chamber, the upper end of said lower tubular housing being isolated from said lower chamber;

said output shaft seal is mounted within said lower tubular housing and of a type designed to limit leakage as much as possible, such as a mechanical face seal.

2. The improved pressure compensating system for components of claim 1, wherein a plurality of drive shaft seals is disposed along said drive rod string in said upper chamber, the uppermost of said drive shaft seals of a type that allows controlled leakage across said shaft seal, all other said drive shaft seals of a type designed to limit leakage as much as possible;

said plurality of drive shaft seals are mounted within said tubular housing; wherein adjacent said drive shaft seals are separated by an inter-seal volume consisting of the annular space between said drive rod string and said tubular housing;

said inter-seal volume between said uppermost shaft seal and said adjacent shaft seal is connected for pressure communication to said external chamber of said upper chamber pressure compensator;

said inter-seal volumes between all other said adjacent drive shaft seals are each connected for pressure and flow communication with the internal chamber of the individual upper inter-seal volume pressure compensators, the external chamber of each said individual upper inter-seal pressure compensator is connected for pressure and flow communication with said external chamber of the said upper chamber pressure compensator;

said upper inter-seal volume compensators consist of an external and an internal chamber, the fluid from said external and said internal chambers are isolated from one another via a piston or flexible membrane, said piston or flexible membrane allowing pressure equalization between said chambers;

a plurality of output shaft seals are disposed along said transmission output shaft seals in said lower chamber, said output shaft seals of a type designed to limit leakage as much as possible;

said plurality of output shaft seals are mounted within said lower tubular housing;

adjacent said output shaft seals are separated by an inter-seal volume consisting of the annular space between said transmission output shaft and said lower tubular housing;

the inter-seal volumes between said adjacent output shaft seals are each connected for pressure and flow communication with the internal chamber of individual inter-seal volume pressure compensators, the external chamber of each said individual inter-seal pressure compensator connected for pressure and flow communication with said tubular member;

said connections between said inter-seal pressure compensators and said tubular member are along the length of said tubular member;

said inter-seal volume pressure compensators consist of an external and an internal chamber, the fluid within said external and said internal chambers isolated from one another via a piston or flexible membrane, said piston or flexible membrane allowing pressure equalization between the chambers.

3. The improved pressure compensation system of claim 2, wherein at least two said output shaft seals are disposed along said transmission output shaft, the lowermost of said output shaft seals of a type that allows controlled leakage across said shaft seal, all other said output shaft seals of a type to limit leakage as much as possible;

said at least two output shaft seals are mounted within said lower tubular housing, said at least two output shaft seals being separated by an inter-seal volume consisting of the annular space between said transmission output shaft and said lower tubular housing;

said inter-seal volume between said lowermost shaft seal and said adjacent shaft seal is connected for pressure communication to said tubular member;

said connections between said inter-seal volume and said tubular member is along the length of said tubular member;

a bleed value assembly is installed in said tubular member between said tubular member intake and said connections with said inter-seal volumes;

said bleed valve assembly allows free flow of liquid into said inlet end of said tubular member, and restricts flow out of said tubular member to a low rate to prevent rapid pressure drop in said inter-seal volumes.

* * * * *